United States Patent [19]

Ozunas

[11] Patent Number: 4,738,412

[45] Date of Patent: Apr. 19, 1988

[54] AIR STABILIZED GIMBAL PLATFORM

[75] Inventor: Gary A. Ozunas, Ridgecrest, Calif.

[73] Assignee: The United States of America as represented by the Secretary of the Navy, Washington, D.C.

[21] Appl. No.: 89,099

[22] Filed: Aug. 24, 1987

[51] Int. Cl.[4] ..... F42B 15/027
[52] U.S. Cl. ..... 244/3.21; 244/3.16
[58] Field of Search ..... 244/3.21, 3.15, 3.16

[56] References Cited

U.S. PATENT DOCUMENTS

| | | | |
|---|---|---|---|
| 3,272,124 | 9/1966 | Marsh et al. | 102/50 |
| 3,355,130 | 11/1967 | Dell | 244/3.21 |
| 4,085,910 | 4/1978 | Baker et al. | 244/3.16 |
| 4,168,813 | 9/1979 | Pinson et al. | 244/3.15 |
| 4,291,849 | 9/1981 | Rodgers et al. | 244/3.22 |
| 4,396,878 | 8/1983 | Cole et al. | 244/3.15 |
| 4,438,893 | 3/1984 | Sands et al. | 244/3.21 |
| 4,512,537 | 4/1985 | Sebestyen et al. | 244/3.21 |

OTHER PUBLICATIONS

Gunston, Bill; "Rockets & Missiles"; pp. 126–127; 1979; New York, New York.

*Primary Examiner*—Charles T. Jordan
*Attorney, Agent, or Firm*—W. C. Townsend; W. Thom Skeer

[57] ABSTRACT

A sensor is disposed within a missile housing upon a mount that permits the sensor to pivot about a first axis, orthogonal to a longitudinal axis of the missile, and about a second axis orthogonal to the first axis. A first set of opposing fins is disposed externally of the housing and is coupled to the mount at its first axis by a pair of pivots that extend through and are pivotally mounted to the housing. The sensor is aligned about the first axis with an airflow that impinges upon the first set of fins. A second set of opposing fins is disposed externally of the housing and is mounted thereto for pivotal movement about a third axis orthogonal to the first axis and longitudinal axis by another pair of pivots that extend through the housing. A guide member is attached to these pivots internally of the housing. A follower is attached to the sensor and engages the guide member so that the sensor is aligned about the second axis with the airflow impinging upon the second set of fins.

8 Claims, 3 Drawing Sheets

AIR STABILIZED GIMBAL PLATFORM

BACKGROUND OF THE INVENTION

1. Field of the Invention

The invention pertains generally to missile stabilization or trajectory control. More particularly, the invention pertains to attitude control mechanisms. In yet greater particularity, the invention pertains to sensors for guided missile control. In still greater particularity, the invention relates to an air stabilized gimbal sensor platform.

2. Description of the Prior Art

Many stabilized missile sensor systems have complicated and costly components such as rate gyros, accelerometers, torque motors and the like. Further, the guidance computations and commands of these systems can be highly complex. Though systems of this type have a high performance capability, their costs and complexities make them unattractive for large-scale, general usage.

SUMMARY OF THE INVENTION

The invention provides a relatively simple, low-cost, air stabilized platform for a missile sensor. The missile sensor is mounted within a gimbal ring that is in turn mounted within a housing attached to the missile. The gimbal ring mount provides the sensor with pivotal movement about a first axis, orthogonal to a longitudinal axis of the missile, and about a second axis orthogonal to the first axis.

To align or stabilize the missile sensor about the first and second axes with an airflow moving over the missile housing, two sets of opposing fins are used. A first set of fins is disposed externally of the housing and is coupled to the mount at its first axis by a pair of pivots that extend through and are pivotally mounted to the housing. The sensor is aligned about the first axis with the airflow that impinges upon the first set of fins. A second set of fins is disposed externally of the housing and is mounted thereto for pivotal movement about a third axis orthogonal to the first axis and longitudinal axis by another pair of pivots that extend through the housing. A half ring is positioned within the housing externally of and concentric to the gimbal ring and is connected to the pivots extending from the second set of fins. A follower is attached to the sensor's body and rides a track defined by the half ring so that the sensor is aligned about the second axis with the airflow impinging upon the second set of fins. The half ring and follower permit the sensor to pivot about the second axis without interfering with the movement of the sensor about the first axis.

In operation, the air stabilized gimbal platform decouples the missile sensor from spurious airframe motions and angle of attack—lift generation missile attitudes and serves to align the sensor with the relative airflow running over the missile body.

OBJECTS OF THE INVENTION

A primary object of the invention is to provide a low cost stabilized platform for a missile sensor.

Another object of the invention is to provide a stabilized platform that has a simple mode of operation.

Another object of the invention is to provide a stabilized platform that is easy to manufacture.

BRIEF DESCRIPTION OF THE DRAWINGS

These and other objects of the invention will become apparent when the following specification, drawings and claims are taken together in which:

DESCRIPTION OF THE PREFERRED EMBODIMENT

Figure 1:
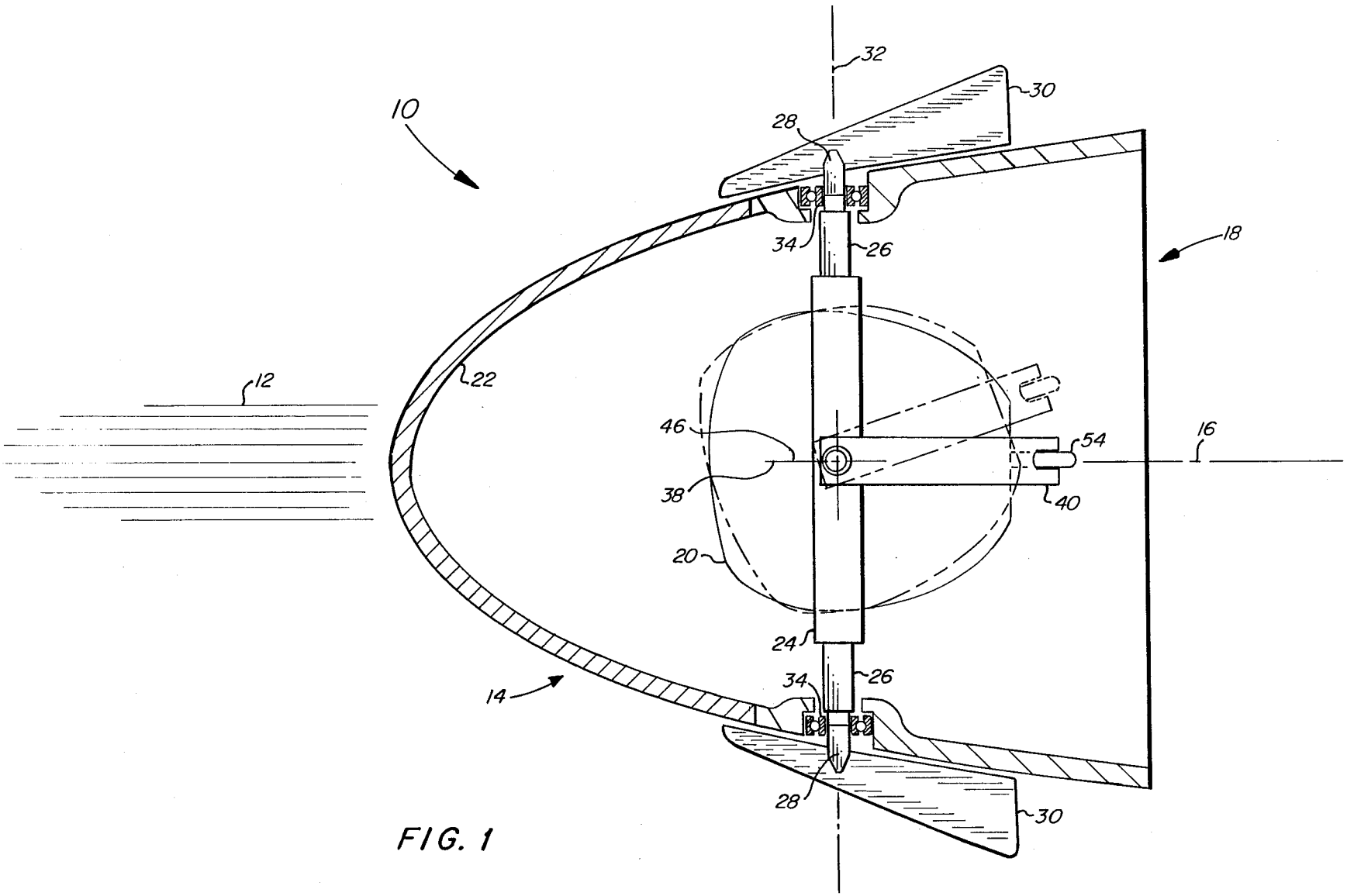
FIG. 1 is a side view of a platform of the invention positioned within a sectioned fragmentary missile housing.

FIG. 1 shows portions of a representative missile 10 in an airflow 2. Missile 10 has a housing 14 and a longitudinal axis 16. A platform 18 of the present invention is shown included with missile 10. Platform 18 includes a sensor base 20 disposed within housing 14. Sensor base 20 mounts a sensor, not shown, that peers through a nose 22 attached to housing 14. Platform 18 further includes a ring 24, best shown in FIG. 3, that encircles sensor base 20. A first set of axles 26 pivotally connect ring 24 to housing 14. A pair of pivots 28 are coaxially connected to axles 26, and are extended through and pivotally mounted to housing 14. A first pair of fins or vanes 30 are attached individually to pivots 28 externally of housing 14. Ring 24, axles 26, pivots 28 and fins 30 pivot about a first axis 32 orthogonal to longitudinal axis 16. Because of this arrangement, ring 24 becomes aligned with airflow 12 moving over housing 14 as the flow impinges upon fins 30.

In practice, axles 26 and pivots 28 are made as a single unit and are assembled with the remainder of platform 18. However, as is apparent from FIG. 1, axles 26 and pivots 28 can be separate units, with pivots 28 and fins 30 being attached to axles 26 shortly prior to the use of missile 10, thereby preventing damage that might otherwise occur to platform 18 during routine missile storage and handling. Further, though FIG. 1 shows axles 26 and pivots 28 being rotatably received within a set of bearings 34, such bearings may be done away with in cases where close tolerances are unnecessary. Finally, in cases where longitudinal movement of axles 26 with respect to housing 14 becomes excessive, shims or other conventional alignment means may be used where necessary to prevent such movement.

Figure 2:
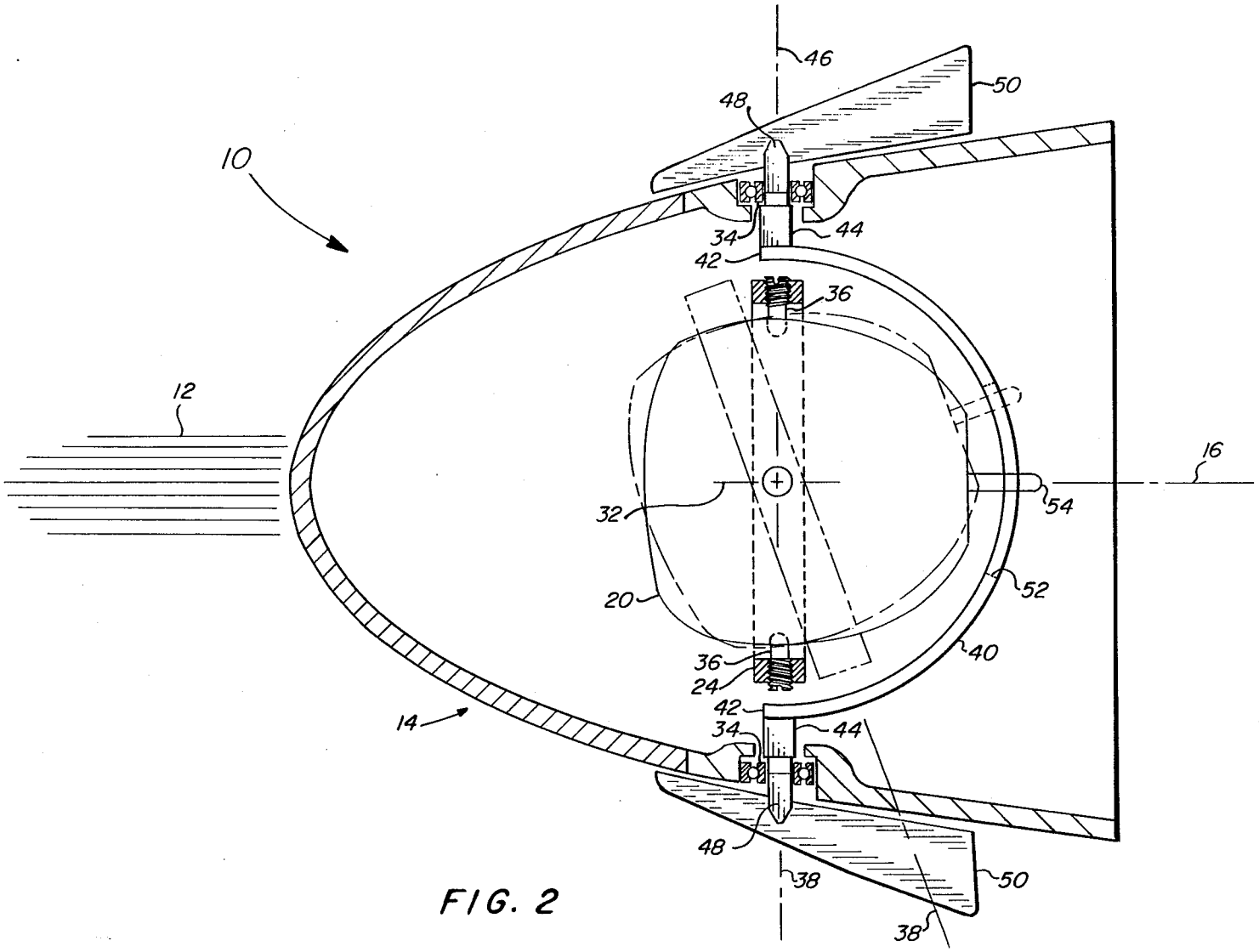
FIG. 2 is a side view of the platform and housing of FIG. 1 taken at a right angle thereto.

Referring now to FIG. 2, it can be seen that a second set of axles 36 pivotally connect sensor base 20 to ring 24 for providing sensor base 20 with pivotal movement about a second axis 38 orthogonal to first axis 32. Platform 18 further includes a half ring 40 placed within housing 14 externally of ring 24 and concentric thereto. Half ring 40 has diametrically opposite ends 42 each of which are connected to an axle 44. Axles 44 are in turn pivotally mounted to housing 14 for providing half ring 40 with pivotal movement about a third axis 46 orthogonal to longitudinal axis 16 and first axis 32. A pair of pivots 48 are coaxially connected to axles 44 and extend through and are pivotally mounted to housing 14. A second pair of fins or vanes 50 are attached individually to pivots 48 externally of housing 14. Airflow 12 moving over housing 14 pivots fins 50, pivots 48, axles 44 and half ring 40 about third axis 46 so that half ring 40 is aligned with the airflow.

As with pivots 28 and fins 30, pivots 48 and fins 50 can be attached to missile 10 immediately prior to use or, as with axles 24 and pivots 28, axles 44 and pivots 48 can be made as a unit to be attached while the remainder of platform 18 is being assembled. Further, though axles 44 and pivots 48 are shown being rotatably received within bearings 34, such bearings are unecessary where tolerances are not critical.

Figure 3:
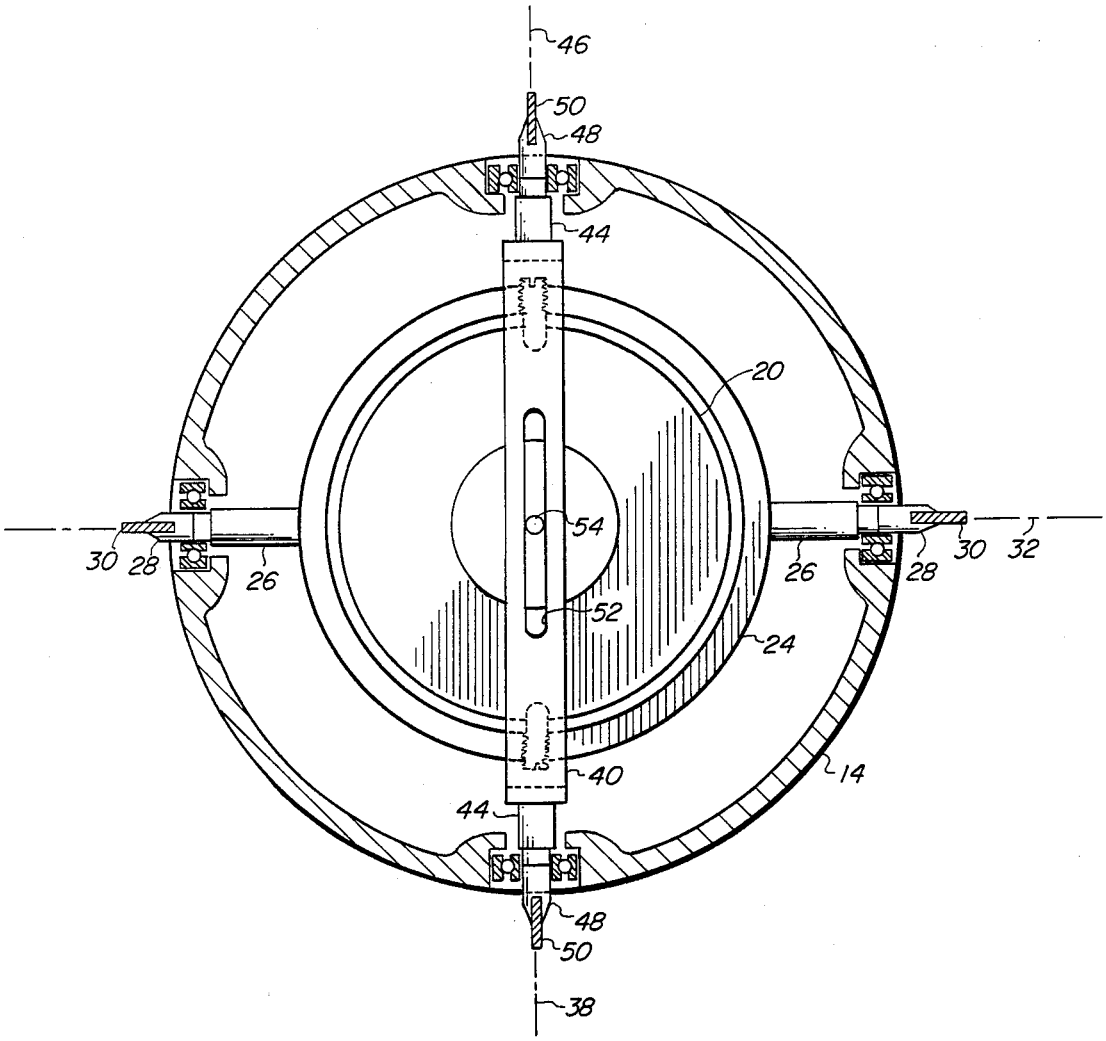
FIG. 3 is an aft view of the platform of the invention shown positioned within a sectioned fragmentary missile housing.

As can be seen in FIGS. 2 and 3, half ring 40 defines an arcuate longitudinal groove or track 52. A follower 54 is attached to sensor base 20 and engages track 52.

Referring now to FIGS. 1, 2 and 3, it is apparent that sensor base 20, with a sensor attached thereto, pivots or swivels, along with ring 24, axles 26, pivots 28 and fins 30, about first axis 32 and becomes aligned about this axis with airflow 12 that impinges upon first fins 30. It is also apparent from the figures that airflow 12 impinges upon second fins 50 to cause fins 50, pivots 48, axles 44 and half ring 40 to pivot about third axis 46. This movement is transmitted to follower 54, attached to sensor base 20, to pivot or swivel sensor base 20 about second axis 38 without inhibiting the movement of sensor base 20 about first axis 32. Sensor base 20 thereby becomes aligned with airflow 12 about second axis 38.

Referring to FIGS. 1 and 2, alternate positions of sensor base 20, ring 24, half ring 40 and follower 54 are shown in phantom lines to more clearly illustrate the pivotal movement of sensor base 20.

Where a scanning sensor is deemed desirable, a motivator such as a stepper motor could be connected to the sensor's axles or pivots to provide a scanning movement. In addition, where precise fin or vane position must be known, angle position sensors such as potentiometers may be placed on the fin's axles or pivots.

Obviously, those skilled in the art will realize that these and other modifications and variations of the invention are possible in light of the above teachings. Therefor, it is to be understood that within the scope of the following claims the invention may be practiced otherwise than as specifically described.

What is claimed is:

1. A sensor platform stabilized by an airflow, the platform comprising:

a housing;

a sensor base disposed within said housing;

gimbal means disposed within said housing and pivotally attached to said housing and to said sensor base for mounting said sensor base for pivotal movement about two mutually orthogonal axes;

a plurality of pivot means connected to said gimbal means and pivotally mounted to said housing, said pivot means being extended through said housing; and a plurality of vane means which are individually connected to said pivot means externally of said housing for aligning said sensor base with the airflow.

2. The platform of claim 1 in which said gimbal means includes:

a ring encircling said sensor base;

a first set of axles pivotally connecting said ring to said housing; and a second set of axles pivotally connecting said ring to said sensor base.

3. A sensor platform stabilized by an airflow and attached to a missile having a longitudinal axis, the platform comprising:

a housing fixedly attached to said missile;

a sensor base disposed within said housing;

gimbal means disposed within said housing and pivotally attached to said housing and said sensor base for mounting said sensor base for pivotal movement about a first axis generally orthogonal to said longitudinal axis and for pivotal movement about a second axis generally orthogonal to said first axis;

first pivot means connected to said gimbal means and pivotally mounted to said housing, said first pivot means extending through said housing;

first vane means connected to said first pivot means externally of said housing for pivoting said sensor base about said first axis to align said sensor base with the airflow;

second pivot means connected to said sensor base and pivotally mounted to said housing, said second pivot means being extended through said housing; and second vane means connected to said second pivot means externally of said housing for pivoting said sensor base about said second axis to align said sensor base with the airflow.

4. The apparatus of claim 3 in which said gimbal means includes:

a ring encircling said sensor base;

a first set of axles pivotally connecting said ring to said housing; and a second set of axles pivotally connecting said ring to said sensor base.

5. The platform of claim 3 in which said first pivot means includes:

a pair of pivots oppositely mounted to said housing for pivotal movement relative thereto about said first axis.

6. The platform of claim 3 in which said second pivot means includes:

a pair of pivots oppositely mounted to said housing for pivotal movement relative thereto about a third axis generally orthogonal to said longitudinal axis, said pivots being extended through said housing;

a guide member disposed internally of said housing and attached to said pair of pivots for pivotal movement therewith, said guide member defining a track; and a follower attached to said sensor base, said follower being engaged with said track of said guide member so that said sensor base is pivotable about said first axis relative to said guide member and so that said sensor base is precluded from being pivoted about said second axis relative to said guide member.

7. The apparatus of claim 6 in which said guide member is a half ring defining an arcute longitudinal track, said half ring having diametrically opposite ends connected to said pair of pivots.

8. An airflow stabilized sensor platform for use in a guided missile having a longitudinal axis, the platform comprising:

a housing fixedly attached to said missile;

a ring disposed within said housing;

first and second pivots oppositely mounted to said housing for pivotal movement relative thereto about a first axis generally orthogonal to said longitudinal axis, said ring being fixedly connected to said first and second pivots for pivotal movement therewith, said first and second pivots extending through said housing;

first and second fins fixedly attached individually to said first and second pivots externally of said housing, said ring being pivotable with said first and second pivots about said first axis to align said ring with the airflow;

a sensor base disposed concentrically within said ring and mounted thereto for pivotal movement about a second axis generally orthogonal to said first axis;

a half ring disposed within said housing externally of said ring and concentric thereto, said half ring defining an arcuate longitudinal track and having diametrically opposite ends;

third and fourth pivots oppositely mounted to said housing for pivotal movement relative thereto about a third axis generally orthogonal to said longitudinal axis and to said second axis, said half ring being fixedly connected at said opposite ends to said third and fourth pivots for pivotal movement therewith, said first and fourth pivots extending through said housing;

third and fourth fins fixedly attached individually to said third and fourth pivots externally of said housing, said half ring being pivotable with said third and fourth fins about said third axis to align said half ring with the airflow; and a follower attached to said sensor base and engaged with said arcuate longitudinal track of said half ring so that said sensor base is pivotable about said first axis relative to said half ring and so that said sensor base is precluded from pivoting about said second axis relative to said half ring.

* * * * *